United States Patent [19]

Bhalla

[11] Patent Number: 4,479,074

[45] Date of Patent: Oct. 23, 1984

[54] HIGH INTENSITY VAPOR DISCHARGE LAMP WITH SINTERING AIDS FOR ELECTRODE EMISSION MATERIALS

[75] Inventor: Ranbir S. Bhalla, Pine Brook, N.J.

[73] Assignee: North American Philips Lighting Corp., New York, N.Y.

[21] Appl. No.: 414,274

[22] Filed: Sep. 2, 1982

[51] Int. Cl.[3] ..... H01J 61/073

[52] U.S. Cl. ..... 313/628; 313/630; 313/346 R

[58] Field of Search ..... 313/630, 628, 346 R, 313/633

[56] References Cited

U.S. PATENT DOCUMENTS

| | | | |
|---|---|---|---|
| 3,708,710 | 1/1973 | Smyser et al. | 313/630 X |
| 4,052,634 | 6/1977 | De Kok | 313/630 |
| 4,123,685 | 10/1978 | Bhalla | 313/628 |
| 4,152,619 | 5/1979 | Bhalla | 313/630 X |
| 4,152,620 | 5/1979 | Bhalla | 313/630 X |
| 4,321,503 | 3/1982 | Bhalla | 313/630 |

*Primary Examiner*—Palmer C. Demeo

[57] ABSTRACT

Sintering aids are disclosed which improve the sintering of emission materials in high pressure discharge lamps. The sintering aid is $Nb_2O_5$ or $Ta_2O_5$ or a mixture thereof along with an alkaline earth oxide with is mixed in the amount of 2 to 15 weight percent sintering aid with 98 to 85 weight percent electron emissive material.

6 Claims, 6 Drawing Figures

HIGH INTENSITY VAPOR DISCHARGE LAMP WITH SINTERING AIDS FOR ELECTRODE EMISSION MATERIALS

BACKGROUND OF THE INVENTION

This invention relates to high intensity discharge (HID) lamps and more particularly to sintering aids for use with the electron emissive material used in the electrodes of such lamps. High pressure sodium-mercury vapor lamps have in the past utilized as electron emissive material a mixture of several oxide phases comprising thorium dioxide, barium thorate, dibarium calcium tungstate and barium oxide. This mixture of oxide phases was quite sensitive to the atmospheric contaminants with a result that even a brief exposure to air resulted in a relatively large absorption of water and carbon dioxide by the emission material. Such contaminatnts were rather difficult to remove. Silica ($SiO_2$) was an effective sintering aid for the foregoing emission material.

In U.S. Pat No. 3,708,710 dated Jan. 2, 1973, there is disclosed a high intensity discharge lamp utilizing an electron emitting material of dibarium calcium tungstate ($Ba_2CaWO_6$) that has the properties of providing copious electron emission and resistance to vaporization and ion bombardment. This material is particularly suitable as emissive material for electrodes used in high pressure sodium vapor lamps where electron emission is necessary above 1000° C. and electron emission material evaporation rates must be kept low.

In U.S. Pat. No. 4,052,634 dated Oct. 4, 1977, there is disclosed a high-pressure gas discharge lamp having an electrode with an electron emitting material which contains an alkaline earth metal and at least one of the metals tungsten and molybdenum, and is characterized in that the electron emitting material consists mainly of at least one oxidic compound containing at least one of the rare earth metal oxides, alkaline earth metal oxide in a quantity of 0.66 to 4 mole per mole of rare earth metal oxide and at least one of the oxides of tungsten and molybdenum in a quantity of 0.25 to 0.40 mole per mole of alkaline earth metal oxide, the alkaline earth metal oxide consisting of at least 25 mole percent of barium oxide.

In U.S. Pat. No. 4,123,685 dated Oct. 31, 1978, there is disclosed a high intensity discharge lamp utilizing an electron emissive material consisting essentially of a solid solution of dibarium calcium tungstate ($Ba_2CaWO_6$) and dibarium calcium molybdate ($Ba_2CaMoO_6$) wherein the molar ratio of the tungstate to molybdate falls within the range of from 9:1 to 1:9. The emissive properties of the electrode are especially well suited for use in high pressure sodium mercury lamps because the vapor pressure of the emission material is low resulting in low evaporation of the emissive material.

In U.S. Pat. No. 4,152,619 dated May 1, 1979, there is disclosed a high intensity discharge lamp with an electron emissive material portion of the lamp electrodes consisting of $M_3M'_2M''O_9$ wherein M is an alkaline earth metal and at least principally comprises barium; M' is yttrium, a lanthanide series rare earth metal, or any mixtures thereof; and M'' is tungsten, molybdenum, or mixtures thereof. The specified material is stable, highly electron emissive and has a low vapor pressure.

In U.S. Pat. No. 4,152,620 dated May 1, 1979, there is disclosed a sintering aid which improves the sintering of emission materials in high pressure discharge lamps.

The sintering aid is a eutectic composition of at least one of barium oxide-tungsten oxide ($BaO-WO_3$), calcium oxide-tungsten oxide ($CaO-WO_3$), or strontium oxide-tungsten oxide ($SrO-WO_3$) and is mixed with the emission materials in quantities of about 2 to 50 weight percent sintering aid. This sintering aid results in a significantly improved electrode structure and essentially elminates any problems of dusting during handling of finished electrodes and finished lamps which can cause contamination of the arc tube, additionally it introduces no foreign elements into the emission material described in U.S. Pat. No. 4,123,685 and 4,152,619.

In U.S. Pat. No. 4,321,503 dated Mar. 23, 1982, there is disclosed a high intensity discharge lamp where the electron emissive material portion of the lamp electrodes is $Ba_3CaM_2O_9$ wherein M is niobium, tantalum, or any combination thereof. Such electrode material is highly emissive, refractory, and essentially non-reactive with water.

SUMMARY OF THE INVENTION

In accordance with the present invention, sintering aids comprising $Nb_2O_5$ or $Ta_2O_5$ or a mixture thereof along with an alkaline earth oxide are mixed with the electron emissive material in the discharge sustaining electrode of a high intensity discharge lamp. The electron emissive material and the sintering aid are present in amounts of from about 2 to 15 weight percent sintering aid and from about 98 to 85 weight percent electron emissive material.

The high intensity vapor discharge lamp generally comprises a radiation transmitting arc tube having electrodes operatively supported therein proximate the ends thereof which are adapted to have an elongated arc discharge maintained therebetween and means for connecting the electrodes to an energizing power source. An improved structure for electrodes is provided which comprises an elongated refractory metal member having one end portion thereof supported proximate an end of said arc tube and the other end portion of said metal member projecting a short distance inwardly within the arc tube. The inwardly projecting ends are provided with an overfitting refractory metal coil means carried on the inwardly projecting portion thereof. An electron emissive material is carried intermediate the turns of the overfitting coil. This electron emissive material selected from one of the group consisting essentially of $Ba_2CaM''O_6$, $M_3M'_2M''O_9$, and $Ba_3CaM'''_2O_9$, wherein: M is an alkaline earth metal and at least principally comprises barium; M' is yttrium, a lanthanide series rare earth metal, or any mixtures thereof; M'' is tungsten, molybdenum, or mixtures thereof; and M''' is niobium, tantalum, or mixtures thereof. For some types of lamps, it is preferred to mixture refractory metal powder with the specified emissive material. When the electron emissive material consists of $Ba_3CaNb_2O_9$, $Ba_3CaTa_2O_9$, or a mixture thereof, another advantage of this sintering aid is that no extraneous material is introduced into the emission mixture.

BRIEF DESCRIPTION OF THE DRAWINGS

Many of the attendant advantages of the present invention will become better understood as the following detailed description is considered in connection with the accompanying drawings in which.

DESCRIPTION OF THE PREFERRED EMBODIMENTS

Figure 1:
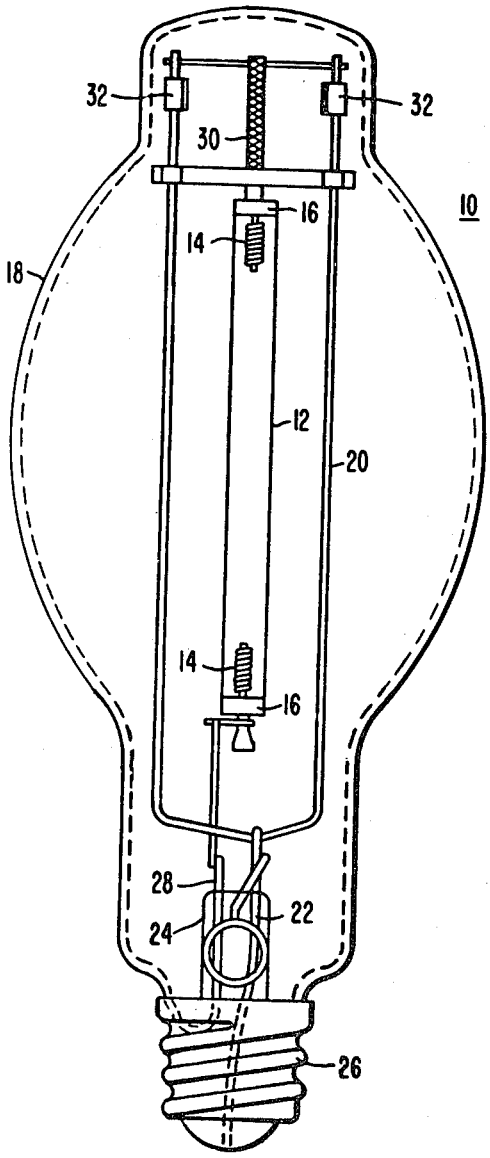
FIG. 1 is an elevational view of a typical high intensity discharge sodium-mercury lamp which incorporates the present improved electrodes.

Reference now in detail to the drawings wherein like reference characters represent like parts throughout the several views, there is illustrated in FIG. 1 the typical high intensity discharge sodium-mercury lamp 10 comprising a radiation transmitting arc tube 12 having electrodes 14 operatively supported therein proximate the ends thereof and adpated to have an elongated arc discharge maintained therebetween. The arc tube is fabricated of refractory material such as the single crystal or polycrystalline alumina having niobium end caps 16 sealing off the ends thereof. The arc tube 12 is suitably supported within a protective outer envelope 18 by means of supporting frame 20 which is connected to one lead-in conductor 22 sealed through a conventional stem press arrangement 24 for connection to the conventional lamp base 26. The other lead-in conductor 28 connects to the other lamp electrode 14. Electrical connection to the uppermost electrode 14 is made through the frame 20 and a resilient braided connector 30 to facilitate expansion and contraction of the arc tube 12 and the frame 20 is maintained in position within the bulb by suitable metallic spring spacing members 32 which contact the inner surface of the dome portion of the protective envelope 18. As a discharge sustaining filling, the arc tube contains a small controlled charge of sodium-mercury amalgam and a low pressure of inert ionizable starting gas such as 20 torr of xenon.

Figure 2:
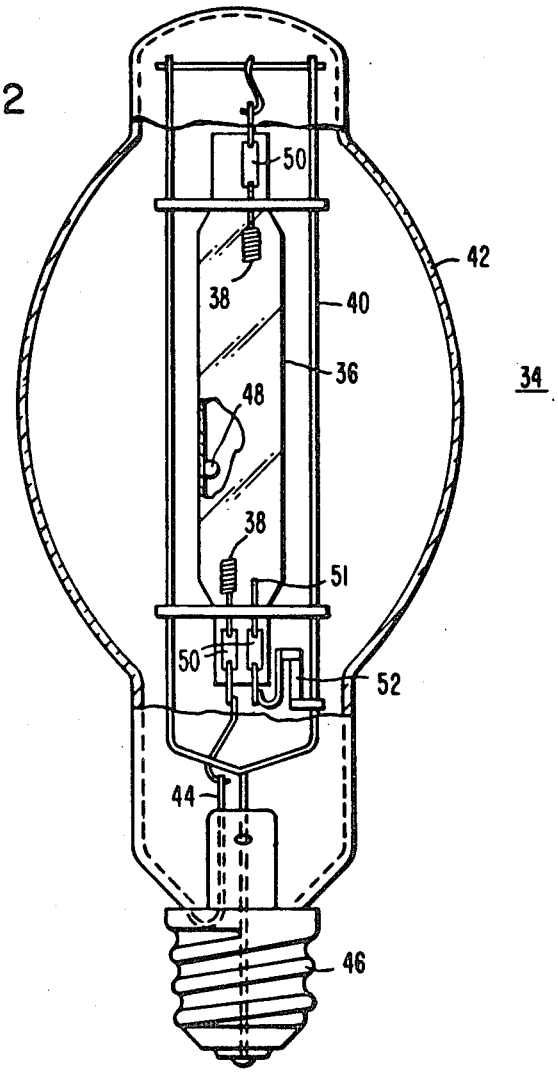
FIG. 2 is an elevational view of a high intensity discharge mercury vapor lamp which incorporates the present electrodes.

The high pressure mercury vapor lamp 34 is shown in FIG. 2 is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to one of the electrodes. The other electrode is connected directly to one of the lead-in conductors 44 and then to the base 46 so that the combination provides means for connecting the lamp electrodes 38 to an energizing power source. As is conventional, the lamp contains a small charge of mercury 48 which together with an inert ionizable starting gas comprises a discharge-sustaining filling. In this lamp embodiment ribbon seals 50 provided at the ends of the arc tube 36 facilitate sealing the lead-in conductors therethrough in order to connect the electrodes. A conventional starting electrode 51 connects to the frame 40 through a starting resistor 52.

Figure 3:
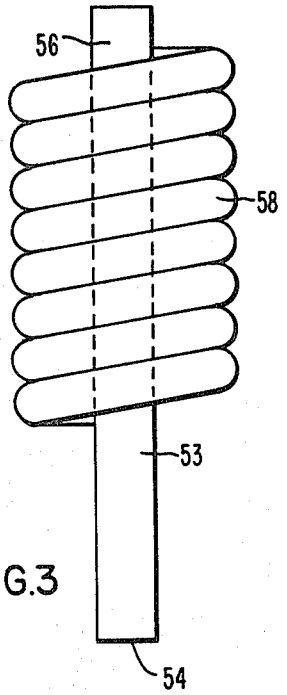
FIG. 3 is an enlarged view of the electrode portion showing the refractory coil carried thereon.

FIG. 3 illustrates an enlarged fragmentary view of an electrode suitable for use in a high intensity discharge lamp. The electrode comprises an elongated refractory metal member 53 having one end portion thereof 54 which is adapted to be supported proximate the end of the lamp arc tube with the other end portion 56 of the metal member adapted to project a short distance inwardly within the arc tube. An overfitting refractory metal coil means 58 is carried on the elongated metal member 53 proximate the end 56 thereof. As a specific example, the elongated metal member is formed as a tungsten rod having a diameter of approximately 0.032 inches (0.8 millimeter) and the overfitting coil 58 as shown in FIG. 3 comprises eight turns of tungsten wire which has a diameter of 0.016 inches (0.4 millimeter). The outer diameter of the coil 58 can vary from 0.09 inches (2.29 millimeter) to 0.11 inches (2.8 millimeter).

Figure 4:
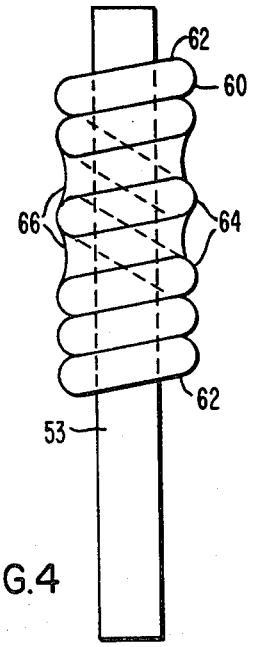
FIG. 4 is an elevational view of the tip portion of the electrode as partially fabricated showing an inner coil which has the improved electron emissive material and sintering aid carried intermediate spaced turns thereof.
Figure 5:
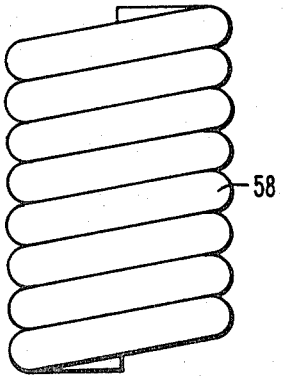
FIG. 5 is an elevational view of the overfitting coil which is screwed in place onto the inner coil as shown in FIG. 4 in order to complete the electrode.

The electrode coil in a state of assembly as shown in FIGS. 4 and 5 wherein the elongated refractory metal member 53 has a first inner coil 60 wrapped directly thereon and having a pitch between individual turns intermediate the coil ends 62 that there exists a predetermined spacing between the centrally disposed turns 64. As a specific example of the spacing between the centrally disposed individual turns 64 is approximately equal to the diameter of the wire from which the inner coil is formed. This spacing forms a protective repository for the majority of the mixture of emissive material and sintering aid 66 which is carried by the electrode structure. An electrode construction such as the foregoing is generally known in the art.

Electron emissive materials suitable for use in high intensity discharge lamps are selected from the group consisting of $Ba_2CaM''O_6$, $M_3M'_2M''O_9$, and $Ba_3CaM'''_2O_9$ where: M is an alkaline earth metal and at least principally comprises barium; M' is yttrium, a lanthanide series rare earth metal, or any mixture thereof; M'' is tungsten, molybdenum, or mixtures thereof; and M''' is niobium, tantalum, or mixtures thereof.

Although each of the foregoing emission materials provides good performance in high intensity discharge lamps, there is a tendency after sintering for the emission material which is now within the electrode structure to be in the form of a soft powder which can be dislodged and dusted off of the electrode. Should this dusting occur, the amount of electron emissive material retained on the electrodes would be reduced and may possibly shorten the life of the lamp. Also, any dusting during lamp life can result in dark emission material particles depositing on the inside surface of the arc tube; these particles have a tendency to quickly spread and darken the arc tube and hence reduce the light output of the lamp. A more unitary consistency is preferred and would reduce the tendency of the emission material to be dislodged from the electrode.

$SiO_2$, commonly used as a sintering aid for the emission material mixtures of thorium dioxide, barium thorate, dibarium calcium tungstate, and barium oxide is not a good sintering aid for the more recently discovered emission materials described above. For example, it was found that even after heating $Ba_3CaNb_2O_9$ and $Ba_3CaTa_2O_9$ emission material particles to 1600° C. with 1% $SiO_2$ the particles did not sinter and tended to dust off during lamp burning and blacken arc tubes.

It has been found that when predetermined amounts of mixtures of at least one alkaline earth oxide of the group consisting of CaO, BaO, and SrO and $Nb_2O_5$ or $Ta_2O_5$ or a mixture thereof are intermixed with the emission material, much harder sintering of the emission material will be accomplished. These sintering aid mixtures may range from 95 mole percent $Nb_2O_5$ with 5 mole percent alkaline earth oxide to 45 mole percent $Nb_2O_5$ with 55 mole percent alkaline earth oxide, and 95 mole percent $Ta_2O_5$ with 5 mole percent alkaline earth oxide to 45 mole percent $Ta_2O_5$ with 55 mole percent alkaline earth oxide. A mixture of the above combinations will also perform suitably.

As a specific example, 190 grams of $Nb_2O_5$ and 10 grams of CaO are ball milled in alcohol and dried in an oven at 80° C. The dry mixture is then placed in silica boats and fired at 1200° C. for 2 hours leaving the eutectic mixture of $Nb_2O_5$ and CaO. The mixture is then again dry ball milled to achieve thorough mixing. A mixture of 90 percent electron emissive material and 10 percent sintering aid is then ball milled with an alcohol vehicle to homogenize the mixture. This material formed as a thick paste using the alcohol vehicle is applied over the innermost coil 60 as shown in FIG. 4. After drying, the outer coil 58 as shown in FIG. 5 is screwed in place over the inner coil to provide an additional degree of protection and to prevent the electron emissive material in combination with the sintering aid 66 from becoming dislodged from the electrode. The completed electrode is then fired at about 1600° C. for about 15 minutes to provide hard sintering of the electron emissive material. This firing is accomplished under hydrogen blanket in order to reduce any free oxides.

BaO or SrO may be substituted for CaO in the above example or a mixture of any of the three may be used. A similar procedure may be followed utilizing $Ta_2O_5$ in place of $Nb_2O_5$ with an alkaline earth oxide as above, or the differing sintering aids can be mixed. Although it is desirable to prefire the sintering aid mixtures it is not necessary and these mixtures may be used in an unfired condition when mixed with the emission material.

The weight percent of electron emissive material to sintering aid may be from about 2 to 15 weight percent sintering aid with between about 98 to 85 weight percent electron emissive material. By adding these sintering aids to selected electron emissive materials for high intensity discharge lamps, the problem of dusting and flaking off of emission material during the fabrication and operation of the discharge lamp can be significantly reduced. Further, when these sintering aids are used with the electron emission materials $Ba_3CaNb_2O_5$ or $Ba_3CaTa_2O_9$ or a mixture thereof, no extraneous material is introduced into the emission material mixture as the niobium, tantalum and oxygen are already present in the electron emissive material and the alkaline earth oxide can be selected for example, CaO or BaO, such that it is also present in the electron emissive material.

Figure 6:
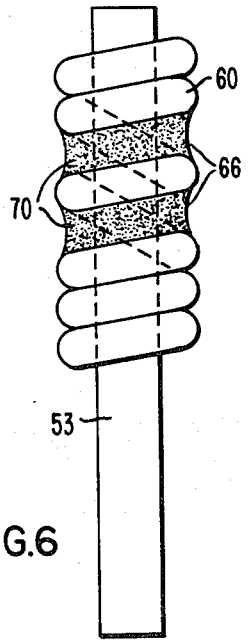
FIG. 6 is an enlarged view of an electrode tip portion generally corresponding to FIG. 3, but wherein to the emission material and sintering aid combination have been added finely divided refractory metal particles.

In the case of mercury vapor HID lamps, it is desirable to mix with the emissive material finely divided refractory metal particles of tungsten, molybdenum, tantalum, or niobium or mixtures thereof, with the refractory metal powder comprising from 20% to 80% by weight of the emission material. The metal powder desirably is in an extremely fine state of division with a representative particle size for the powder being 0.02 to 0.6 micron. Tungsten powder is preferred, with a specific particle size being about 0.11 micron. The added metal powder acts as a refractory matrix to increase the mechanical stability of the emission material and it also minimizes sputtering of the oxide emission material when the lamp is initially started. The preferred finely divided tungsten powder preferably comprises about 20% to about 50% by weight of the emission material. Such a modified mixture is shown in FIG. 6 wherein the emission material 66 has finely divided tungsten particles 70 mixed therewith in amount of about 40% by weight of the emission material.

I claim:

1. In combination with a high intensity vapor discharge lamp comprising a radiation transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

an elongated refractory metal member having one end portion thereof supported proximate an end of said arc tube and the other end portion of said metal member projecting a short distance inwardly within said arc tube, an overfitting refractory metal coil means carried on the inwardly projecting portion of said elongated metal member;

a sintered electron emissive material carried intermediate turns of said overfitting coil means, said electron emissive material selected from one of the group consisting of $Ba_2CaM''O_6$, $M_3M'_2M''O_9$, and $Ba_3CaM'''_2O_9$ where: M is an alkaline earth metal and at least principally comprises barium; M' is yttrium, a lanthanide series rare earth metal, or any mixture thereof; M'' is tungsten, molybdenum, or mixtures thereof; and M''' is niobium, tantalum, or mixtures thereof; and a predetermined percentage of sintering aid intermixed with said electron emissive material, said sintering aid comprising $Nb_2O_5$ or $Ta_2O_5$ or a mixture thereof along with at least one alkaline earth oxide of the group consisting of CaO, BaO, and SrO, wherein said electron emissive material and said sintering aid are present in amounts of from about 2 and 15 weight percent sintering aid and from about 98 and 85 weight percent electron emissive material and said alkaline earth oxide constitutes from about 5 to 55 mole percent of said sintering aid material.

2. The combination as specified in claim 1, wherein said electron emissive material is one of the group consisting of $Ba_3CaNb_2O_9$ and $Ba_3CaTa_2O_9$ or a mixture thereof.

3. The combination of claim 1, wherein said electron emissive material is in combination with a finely divided refractory metal powder.

4. The combination according to claim 3, wherein said refractory metal powder is at least one of tungsten, molybdenum, tantalum or niobium.

5. The combination according to claim 4, wherein said refractory metal powder is present in the amount of from 20 to 80 weight percent of said combined electron emissive material and refractory metal powder.

6. The combination according to claim 4, wherein said refractory metal poweder is present in the amount of from 20 to 50 weight percent of said combined electron emissive material and refractory metal powder.

* * * * *